US006836078B2

(12) United States Patent
Matsumoto

(10) Patent No.: US 6,836,078 B2
(45) Date of Patent: Dec. 28, 2004

(54) CIRCUIT FOR LIGHTING HID LAMP

(75) Inventor: Minoru Matsumoto, Ibaraki (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 10/381,048

(22) PCT Filed: Sep. 26, 2001

(86) PCT No.: PCT/JP01/08357

§ 371 (c)(1),
(2), (4) Date: May 27, 2003

(87) PCT Pub. No.: WO02/28150

PCT Pub. Date: Apr. 4, 2002

(65) Prior Publication Data

US 2003/0184240 A1 Oct. 2, 2003

(30) Foreign Application Priority Data

Sep. 26, 2000 (JP) ..... 2000-293175

(51) Int. Cl.[7] ..... H05B 37/02

(52) U.S. Cl. ..... 315/224; 315/291; 315/DIG. 7; 315/287

(58) Field of Search ..... 315/291, 224–225, 315/246, 276, 283, 307, DIG. 7, 209 R, 244, 287, DIG. 5; 323/901

(56) References Cited

U.S. PATENT DOCUMENTS

| | | | | |
|---|---|---|---|---|
| 4,266,165 A | * | 5/1981 | Handler | 315/224 |
| 4,320,325 A | * | 3/1982 | Anderson | 315/205 |
| 5,034,663 A | * | 7/1991 | Cook et al. | 315/308 |
| 5,434,479 A | | 7/1995 | Ohnishi et al. | 315/209 R |
| 5,442,257 A | | 8/1995 | Mitsumoto | 315/129 |
| 6,130,831 A | | 10/2000 | Matsunaga | 363/98 |

FOREIGN PATENT DOCUMENTS

| | | |
|---|---|---|
| JP | 57168499 | 10/1982 |
| JP | 59-12598 | 1/1984 |
| JP | 62-88293 | 4/1987 |
| JP | 1-298687 | 12/1989 |
| JP | 4-253182 | 9/1992 |
| JP | 6-104090 | 4/1994 |
| JP | 6-111985 | 4/1994 |
| JP | 6-119983 | 4/1994 |
| JP | 6-260293 | 9/1994 |
| JP | 2000-134943 | 5/2000 |

OTHER PUBLICATIONS

English Language Abstract of JP 1–298687.
English Language Abstract of JP 2000–134943.
English Language Abstract of JP 6–111985.
English Language Abstract of JP 4–253182.
Partial English translation of JP–62–88293.
Partial English translation of JP–57–168499.
Partial English translation of JP–59–12598.

* cited by examiner

*Primary Examiner*—Thuy Vinh Tran
(74) *Attorney, Agent, or Firm*—Greenblum & Bernstein, P.L.C.

(57) ABSTRACT

A lighting circuit of confirming the insulation property of an HID lamp and a lighting circuit upon starting the operation of the HID lamp to previously prevent damages of the main circuit, and starting discharge at the lowest starting voltage in accordance with the characteristics of the HID lamp, comprising a control section having an insulation property confirming section for confirming that the current does not flow in a state of applying a predetermined voltage to the main circuit before applying the starting voltage to an HID lamp and a starting voltage variable controller for increasing the secondary voltage generated from the step-up transformer of the starting circuit stepwise after confirming the insulation property.

5 Claims, 4 Drawing Sheets

CIRCUIT FOR LIGHTING HID LAMP

This application is a 371 of PCT/JP01/08357 filed Sep. 26, 2001.

TECHNICAL FIELD

The present invention concerns a lighting circuit for HID lamps such as metal halides lamps used for illumination of indoor commercial facilities such as stores and outdoors facilities, light sources for liquid crystal projectors and headlights for use in automobiles or like other vehicles.

BACKGROUND ART

HID lamps (High Intensity Discharge Lamps) are also referred to as high luminance discharge lamps or high-pressure discharge lamps and since they are not only excellent in light emission efficiency relative to consumption power but also generate less amount of heat for an identical amount of light and have higher safety compared, for example, with halogen lamps, they have been used, in recent years, in a case where light sources of high luminance are required such as in illumination for indoor commercial facilities and outdoor facilities.

The HID lamp starts discharge by the application of a high voltage at about several kV upon starting and, continues discharge subsequently by applying a relatively low lamp voltage of several tens to several hundreds volts and the HID lamps is put in a lighted state along with increasing lamp voltage.

FIG. 4 shows a general light circuit 41 of lighting an HID lamp by an AC rectangular wave voltage and it comprises a main circuit 2 for applying a lamp voltage at several tens to several hundreds volts to an HID lamp 1, and a starting circuit 3 for applying a high starting voltage at several kilo volts.

The main circuit 2 comprises a rectifier circuit 5 for full wave rectification of a sinusoidal AC wave supplied from an AC power source 4, a power factor improving circuit 6 for converting a rectified pulsative voltage into a smooth DC voltage, a power control circuit comprising a chopper circuit 7A for converting the smooth DC voltage into rectangular pulses of a predetermined pulse width and a smoothing circuit 7B for smoothing the rectangular pulses again into a DC lamp voltage at a predetermined voltage value, and an inverter 9 for converting the obtained DC lamp voltage into an AC rectangular wave voltage at a voltage identical therewith, and the inverter 9 is connected by way of the starting circuit 3 to the HID lamp 1.

The starting circuit 3 has a step-up transformer (not illustrated), which generates a high starting voltage at several kilo volts so as to start discharge between electrodes of the HID lamp 1 when a lighting switch (not illustrated) of the HID lamp 1 is turned on.

In the lighting circuit 41, when the lighting switch (not illustrated) is turned on, a starting voltage at several kilo volts is applied to the HID lamp 1 to start discharge and, subsequent to the start of the discharge, discharge continues by the application of a relatively low lamp voltage of several tens to several hundreds volts supplied from the main circuit 2 and the lamp voltage increases gradually to put the HID lamp into a lighted state.

By the way, although the discharge starting voltage is low while the HID lamp 1 is new, when it is exhausted and contaminants are deposited to the electrodes, it becomes less dischargeable to increase the discharge starting voltage.

Further, when the lamp is lighted again after putting off, since the metal vapor pressure in the inside of the lamp is high, it is in a less dischargeable state and also requires application of high voltage when it is intended to compulsorily start discharge.

As described above, since the discharge starting voltage changes depending on the condition of the lamp, the starting voltage is generally set to about 3–5 kV which is sufficiently higher than the discharge starting voltage so that the lamp can be lit reliably irrespective of the lamp condition.

However, when lamps are lit at a uniformly high starting voltage including HID lamps 1 capable of lighting at a lower starting voltage, this results in a problem of damaging electrodes due to excessively high starting voltage to shorten the product life of the HID lamps 1.

On the other hand, if the lamp 1 per se and wirings therefor have no sufficient insulation property upon starting the HID lamp 1, it may be a worry that large current may flow to injure the main circuit 2 when a high starting voltage is applied. In a case where the number of HID lamps 1 is small, it is possible to check individual HID lamps 1 by periodical maintenance. However, in a case where HID lamps 1 are used for the illumination of a large scale retail store having a large area per one floor such as a department store or a supermarket, since a number of lamps are used, it is impossible to check individual HID lamps 1 one by one before the lamp is disconnected.

In view of the above, the present invention has a technical subject of confirming the insulation property of an HID lamp and a lighting circuit-before application of a fine starting voltage to the HID lamp thereby preventing damages to a main circuit when the starting voltage is applied and starting discharge by the application of a lowest starting voltage in accordance with the characteristics of the HID lamp.

DISCLOSURE OF THE INVENTION

According to the present invention, a lighting circuit for an HID lamp of starting discharge by applying a high starting voltage generated by a step-up transformer of a starting circuit to the HID lamp and then applying a low lamp voltage by way of a main circuit thereby causing continuous discharge, in which a switching element to be turned ON and OFF by a control signal of a predetermined pulse width is connected in series with primary coils in the starting circuit, and a capacitor for absorbing counter-electromotive force generated in the primary coils is connected in parallel with the switching element, and comprises a control section having an insulation property confirming means for confirming that a lamp voltage at a predetermined voltage value is applied by way of the main circuit to the HID lamp and that a current does not flow in the main circuit before application of the starting voltage to the HID lamp, and a starting voltage variable controlling means of increasing the amount of a current flowing in primary coils of the step-up transformer stepwise thereby increasing a secondary voltage generated from the secondary coils stepwise.

According to the present invention, an insulation property of the main circuit for applying the lamp voltage to the HID lamp is confirmed at first before starting discharge by applying a high starting voltage to the HID lamp.

The HID lamp before starting of discharge is in a not-conducted state and, accordingly, even when a voltage is applied to the main circuit, current does not flow unless there is abnormality in the main circuit and the HID lamp.

That is, when a power source is turned on, a lamp voltage at a predetermined voltage value is applied by way of the main circuit to the HID lamp and it can be seen that the main circuit and the HID lamp are normal when the current flowing in the main circuit is zero.

Then, when the voltage and the current are detected to confirm the normality, the starting circuit is started.

When the starting circuit is started, since the amount of the current supplied pulsatively to the primary coils of the step-up transformer increases stepwise, the secondary voltage generated from the secondary coil also pulsatively increases stepwise.

Specifically, a switching element to be turned ON and OFF by a control signal of a predetermined pulse width outputted from the control section is connected in series with primary coils of the step-up transformer, and when the pulse width of the control signal is gradually extended from the predetermined minimum width to maximum width, the amount of current supplied to the primary coils changes and the amount of magnetic field energy accumulated in the core also increases or decreases to change the voltage value generated on the secondary side as well.

Accordingly, since the HID lamp is discharged when the starting voltage increases to a voltage value at which the HID lamp starts discharge, it can be discharged reliably at the minimum starting voltage in accordance with the working time, temperature and other characteristics of the HID lamp.

BEST MODE FOR PRACTICING THE INVENTION

An embodiment of the present invention is to be described specifically with reference to the drawings.

Figure 1:
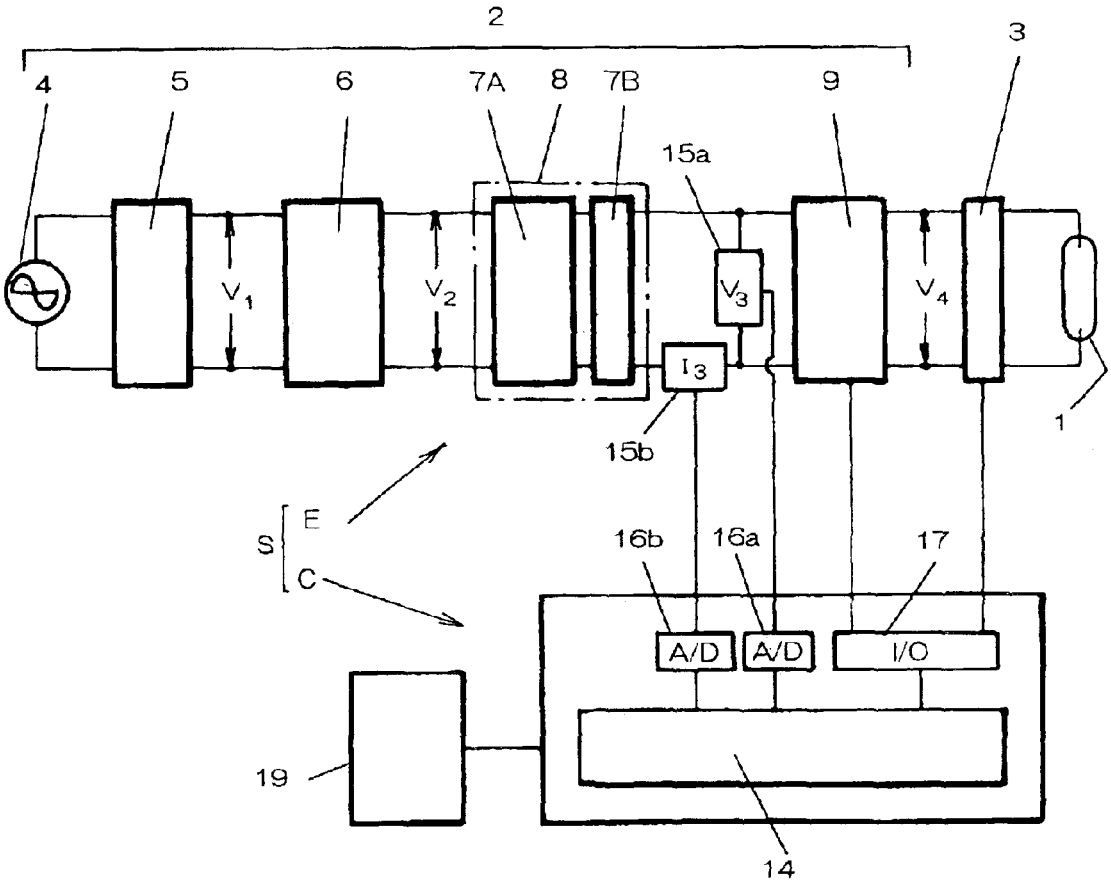
FIG. 1 is a block diagram showing an entire constitution of a lighting circuit according to the present invention.

A light circuit S shown in FIG. 1 comprises a power source circuit E for lighting an HID lamp 1 and a control section C for controlling the power source circuit E, and the power source circuit E has a main circuit 2 for applying a lamp voltage at a relatively low voltage value of several tens to several hundreds volts to the HID lamp 1 and a starting circuit 3 for applying a high starting voltage of several kilo volts.

The main circuit 2 comprises a rectifier circuit 5 for full wave rectification of a sinusoidal AC voltage supplied from a AC power source 4, a power factor improving circuit 6 for converting full-wave rectified pulsative voltage $V_1$ into a smooth DC voltage $V_2$ while supplying a current having a waveform similar therewith, a power control circuit 8 comprising a chopper circuit 7A for controlling the supplied power by converting the smoothed DC voltage $V_2$ into rectangular pulses each of a predetermined pulse width and a smoothing circuit 7B for smoothing the rectangular pulses again into a predetermined DC lamp voltage $V_3$ and a full-bridge type inverter 9 for converting the obtained lamp voltage $V_3$ into an AC rectangular wave voltage $V_4$ at a potential equal therewith, and the inverter 9 is connected by way of the starting circuit 3 to the HID lamp 1.

Figure 2:
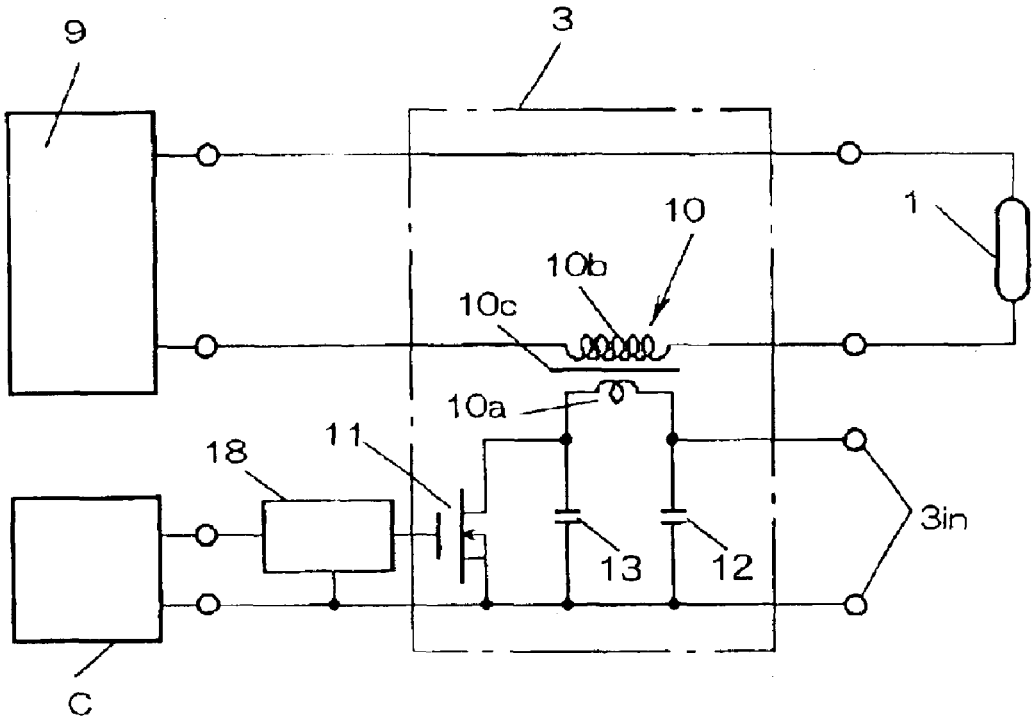
FIG. 2 is a view showing a starting circuit.

As shown in FIG. 2, the starting circuit 3 has a step-up transformer 10 for generating a high starting voltage from a power supplied from an input terminal $\mathbf{3}_{in}$, and FET 11 as an switching element which is turned ON and OFF by a control signal of a predetermined pulse width outputted from a control section C is connected in series with primary coils 10*a* of the step-up transformer 10.

Further, secondary coils 10*b* of the step-up transformer are connected in series with the HID lamp 1 and interposed between the inverter 10 and the HID lamp 1.

12 is a bypass capacitor for releasing high frequency wave to the ground and 13 is a capacitor for absorbing counter-electromotive force generated in the primary coils 10*a* of the step-up transformer 10.

When the control signal is outputted from the control section C in a state of applying a DC voltage to the input terminal $\mathbf{3}_{in}$ of the starting circuit 3, the FET 11 is conducted for a time corresponding to the pulse width, to supply current from the input terminal $\mathbf{3}_{in}$ to the primary coils 10*a* of the step-up coil 10 to accumulate magnetic field energy in the transformer core 10*c*.

Since the amount of the accumulated magnetic field energy is in proportion with the square of the amount of current and the amount of current is controlled by the conduction time of the FET 11, the accumulated magnetic field energy can be controlled by changing the pulse width of the control signal.

Then, when the FET 11 is rendered not conductive by the control signal to interrupt the current flowing to the primary coils 10*a*, the magnetic field energy accumulated in the transformer core 10*c* is released to generate a high starting voltage in the secondary coils 10*b* in accordance with the winding ratio relative to the primary coils 10*a*, which is applied to the HID lamp 1.

The control section C for outputting the control signal comprises, for example, a single chip microcomputer 14 having a voltage detector 10*a* and a current detector 15*b* connected at the input thereof by way of A/D converters 16*a* and 16*b* and a driver 18 connected at the output thereof by way of an I/O port 17 for applying a gate voltage of the FET 11.

19 denotes a communication computer which controls the lighting circuit S based on control signals sent from external equipments (not illustrated), or relays signals between the external equipments and-the control section C corresponding to complicate communication protocols when various control data for the lighting circuit S are sent to the host computer.

Thus, burden of the data processing on the control section C can be moderated to reliably conduct control for the lighting circuit S.

Figure 3:
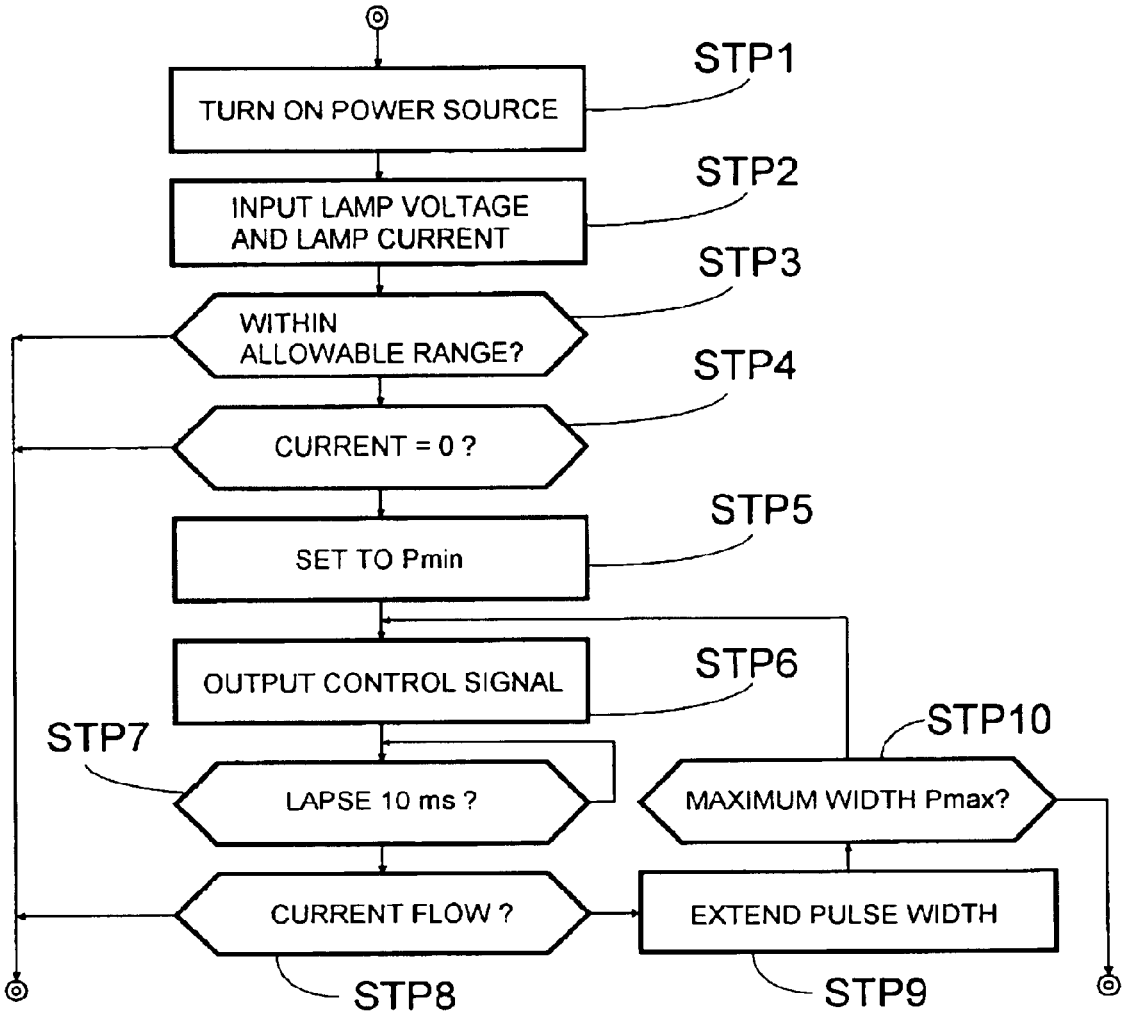
FIG. 3 is a flow chart showing processing procedures of a control section.
Figure 4:
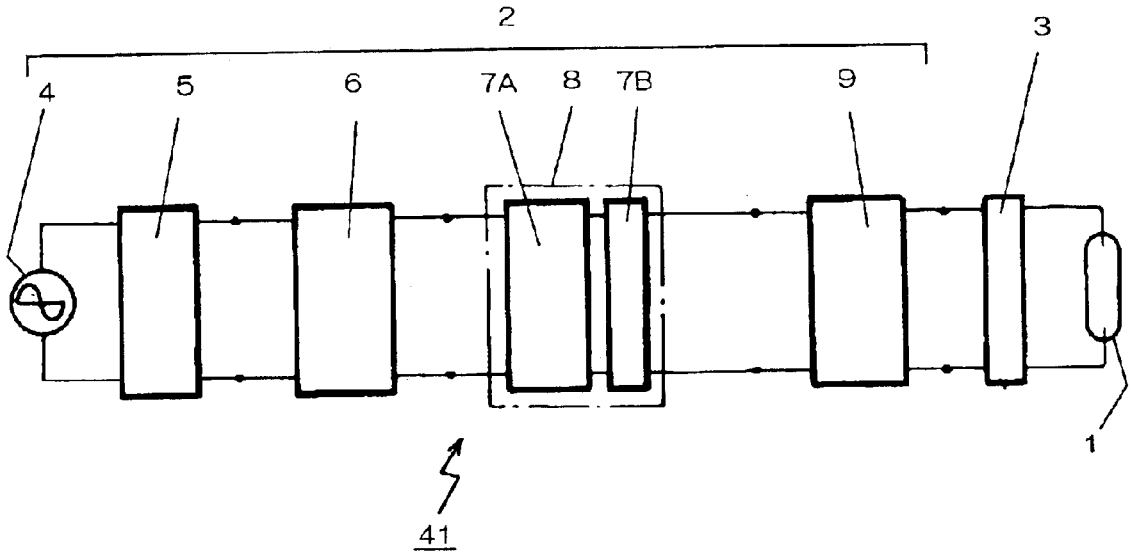
FIG.4 (prior art)
FIG. 4 is a block diagram showing a general lighting circuit explained above.

Then, when the starting switch (not illustrated) is turned ON, the single chip microcomputer 14 executes the starting processing for the HID lamp 1 as shown in FIG. 3.

In the starting processing, at step STP1 at first, an AC power source 4 is turned ON to apply a predetermined lamp voltage by way of the main circuit 2 to the HID lamp 1 and a predetermine DC voltage is applied to the starting circuit 3.

Then, at STP2, a lamp voltage $V_3$ and a lamp current $I_3$ of the main circuit 2 detected by the voltage detector 15*a* and the current detector 15*b* are inputted and, at step STP3, it is judged whether the lamp voltage $V_3$ reaches a rated voltage value and at step STP4 it is judged whether the lamp current $I_3$ is 0 or not.

At step STP3, it is judged whether the lamp voltage $V_3$ detected by the voltage detector 15*a* is within an allowable range of a predetermined non-load lamp voltage value or not and, if it is within the allowable range, it goes to step STP4. If it is out of the range, since some or other abnormality may be considered, the starting processing is interrupted. Since the main circuit 2 is usually maintained in an insulated state before discharging of the HID lamp 1, when current is 0 upon application of the lamp voltage $V_3$, it is judged as normal and it goes from step STP4 to step STP5. If currents flows, it is judged that some or other circuit abnormality, wiring abnormality or lamp abnormality may be present and starting processing is interrupted.

The pulse width of the control signal is set to a predetermined minimum width $P_{min}$ (for example, 0.5 $\mu$s) at step STP5 and, when the control signal of the pulse width is outputted at step STP6, FET 11 is conducted for a time corresponding to the pulse width to accumulate magnetic field energy in the transformer core 10*c*.

Then, it takes about several ms from the instance the FET 11 is rendered not-conductive by the control signal to the application of a high voltage to the HID lamp by the release of the magnetic field energy accumulated in the transformer core 10*c* to start discharging from the HID lamp 1 due to the high voltage.

Then, after lapse of a predetermined time (10 ms) at step STP7, it goes to step STP8 and judges whether current flows or not in the main circuit 2.

That is, since current flows in the main circuit 2 when the HID lamp 1 starts discharging by the application of the high voltage, the starting processing is ended.

Further, when current does not flow in the main circuit 2, since this means that the starting voltage is lower than the discharge starting voltage for the HID lamp 1 and the discharging was not started, it goes to step STP9 and extends the pulse width of the control signal, for example, each by 0.5 $\mu$s.

Then at step STP9, when it is judged that the pulse width does not exceed the predetermined maximum width $P_{max}$, it repeats processings from step STP6 to STP8 and a starting voltage somewhat higher than that in the preceding cycle is applied.

Further, when the pulse width exceeds the predetermined maximum width $P_{max}$, it judges the presence of abnormality in the HID lamp 1 to end the starting processing.

In the processings described above, the processings in STP 2 to step STP4 are a concrete example for the insulation property confirming means and processings from step STP 5 to step STP10 are a-concrete example for the starting voltage variable control means.

An example of a constitution according to the present invention is as has been described above and the operation thereof is to be described.

When a starting switch (not illustrated) is turned ON, the AC power source 4 is turned ON to apply an AC voltage to the main circuit 2 and a predetermined AC rectangular wave voltage V4 is applied by way of the rectifier circuit 5-power factor improving circuit 6-chopper circuit 7A-smoothing circuit 7B-inverter 9 (step STP1).

At the instance, since the HID lamp 1 does not yet start discharging, the main circuit 2 is in a not-conducted state and current does not flow.

Then, the insulation property of the main circuit 2 and the HID lamp 1 is inspected to confirm that the lamp voltage $V_3$ in accordance with the rated power is applied by way of the main circuit 2 to the HID lamp 1, and current does not flow in the main circuit 2 (step STP2 to step STP4).

Then, after confirming the insulation property, the starting circuit 3 is started.

In this case, a control signal with the pulse width being set to the minimum width $P_{min}$ is at first outputted to render the FET 11 of the starting circuit 3 conductive thereby accumulating the minimum magnetic field energy in the transformer core 10*c* of the step-up transformer 10, and a minimum high starting voltage is applied to the HID lamp 1 to trially conduct discharging (step STP5 to step STP7).

Then, when the start of discharging is confirmed, the starting processing is completed at the instance (STP8) and, subsequently, discharge continues by the AC rectangular wave voltage $V_4$ applied by way of the main circuit 2 to the HID lamp 1 to light-up the HIP lamp 1.

Further, as the HID lamp 1 is exhausted, since the discharge starting voltage is increased compared with the state where it was new, the pulse width of the control signal is gradually extended (step STP9 to STP10). Then, the starting voltage generated in the secondary coils 10*b* of the step-up transformer 10 also increases (step STP6, step STP7).

Then, when the starting voltage reaches a discharge starting voltage, discharging is started and the starting processing is completed at the instance this is confirmed (step STP8).

With procedures described above, since the insulation property of the main circuit 2 and the HID lamp 1 can be confirmed before generation of high voltage by the starting circuit 3, the main circuit 2 or the HID lamp 1 is not short circuited and damaged by the high voltage generated from the starting circuit 3.

Further, since the starting voltage generated in the step-up transformer 9 can be increased gradually by gradually extending the pulse width of the control signal, discharging can-be started reliably when the discharge starting voltage corresponding to the characteristics of the HID lamp 1 is reached and there is no requirement of applying a starting voltage higher than the voltage described above.

Accordingly, electrodes are less damaged upon start of discharging and the HID lamp 1 can be made long lasting.

Industrial Applicability

As has been described above in the lighting circuit according to the present invention, since the insulation property of the HID lamp and the main circuit is confirmed before application of a high starting voltage to the HID lamp, damages to the main circuit when the starting voltage is applied can be prevented previously. Further, since the starting voltage is applied to the HID lamp while being increased gradually discharge can be started at the lowest starting voltage in accordance with the characteristics of the HID lamp and it can provide, as a result, an excellent effect capable of extending the life of the HID lamp.

What is claimed is:

1. A lighting circuit for an HID lamp for starting discharge by applying a high starting voltage generated by a step-up transformer of a starting circuit to the HID lamp and then applying a low lamp voltage by way of a main circuit thereby causing continuous discharge, wherein the high starting voltage is greater than the low lamp voltage, the lighting circuit comprising:

a switching element that is turned ON and OFF by a control signal of a predetermined pulse width is connected in series with primary coils in the starting circuit, and a capacitor for absorbing counter-electromotive force generated by the primary coils is connected in parallel with the switching element, and a controller having an insulation property confirming section that confirms that a lamp voltage at a predetermined voltage value is applied by the main circuit to the HID lamp and that a current does not flow in the main circuit before application of the high starting voltage to the HID lamp and a starting voltage variable controller that stepwise increases an amount of current flowing in the primary coils of the step-up transformer, thereby stepwise increasing a secondary voltage generated from secondary coils.

2. A lighting circuit for an HID lamp as recited in claim 1, wherein the secondary voltage generated from the secondary coils of the step-up transformer is increased stepwise by gradually extending the pulse width of the control signal for turning the switching element ON and OFF between a predetermined minimum width and a predetermined maximum width.

3. A lighting circuit for an HID lamp for starting discharge by applying a high starting voltage generated by a step-up transformer of a starting circuit to the HID lamp and then applying a low lamp voltage by way of a main circuit thereby causing continuous discharge, wherein the high starting voltage is greater than the low lamp voltage, the lighting circuit comprising:

a switching element that is turned ON and OFF by a control signal of a predetermined pulse width is connected in series with primary coils in the starting circuit, and a capacitor for absorbing counter-electromotive force generated in the primary coils is connected in parallel with the switching element, and a control section for outputting to the starting circuit, a control signal to increase an amount of current flowing in the primary coils of the step-up transformer stepwise thereby increasing a secondary voltage generated from secondary coils stepwise.

4. A lighting circuit for an HID lamp for starting discharge by applying a high starting voltage generated by a step-up transformer of a starting circuit to the HID lamp and then applying a low lamp voltage by way of a main circuit thereby causing continuous discharge, wherein the high starting voltage is greater than the low lamp voltage, the lighting circuit comprising:

a switching element that is turned ON and OFF by a control signal of a predetermined pulse width is connected in series with primary coils in the starting circuit, and a capacitor for absorbing a counter-electromotive force generated in the primary coils is connected in parallel with the switching element and a controller that confirms that a lamp voltage at a predetermined voltage value is applied to the HID lamp by the main circuit, and that a current does not flow in the main circuit before applying the high starting voltage to the HID lamp.

5. A lighting circuit for an HID lamp for starting discharge by applying a high starting voltage generated by a step-up transformer of a starting circuit to the HID lamp and then applying a low lamp voltage by way of a main circuit, thereby causing continuous discharge, wherein the high starting voltage is greater than the low lamp voltage, the lighting circuit comprising:

a switching element that is turned ON and OFF by a control signal of a predetermined pulse width and is connected in series with primary coils in the starting circuit;

a capacitor that absorbs a counter-electromotive force generated by the primary coils is connected in parallel with the switching element; and a control section for outputting to the starting circuit, a control signal to increase an amount of current flowing in the primary coils of the step-up transformer stepwise thereby increasing a secondary voltage generated from secondary coils stepwise, wherein the secondary voltage generated from the secondary coils of the step-up transformer is increased stepwise by gradually extending the pulse width of the control signal for turning the switching element ON and OFF between a predetermined minimum width and a predetermined maximum width.

* * * * *